US005842743A

United States Patent [19]

Wright et al.

[11] Patent Number: 5,842,743

[45] Date of Patent: Dec. 1, 1998

[54] SOFA BRIDGE

[75] Inventors: Dennis W. Wright, Monroe; Jonathan R. Saul, Erie; Larry P. LaPointe, Temperance; Karl J. Komorowski, Petersburg, all of Mich.

[73] Assignee: La-Z-Boy Incorporated, Monroe, Mich.

[21] Appl. No.: 902,722

[22] Filed: Jul. 30, 1997

Related U.S. Application Data

[63] Continuation of Ser. No. 387,107, Feb. 10, 1995, abandoned, which is a continuation-in-part of Ser. No. 322,790, Oct. 13, 1994, abandoned, which is a continuation-in-part of Ser. No. 958,944, Oct. 9, 1992, Pat. No. 5,374,108.

[51] Int. Cl.[6] ..... B60N 2/02

[52] U.S. Cl. ..... 297/378.1; 297/113; 297/411.33

[58] Field of Search ..... 297/113, 115, 297/378.1, 441.33, 188.04, 188.05, 463.1, 146

[56] References Cited

U.S. PATENT DOCUMENTS

| | | | |
|---|---|---|---|
| 2,098,426 | 11/1937 | McDonald | 297/146 |
| 2,240,748 | 5/1941 | Bak . | |
| 2,714,419 | 8/1955 | Killington . | |
| 2,802,906 | 8/1957 | Goldenburg | 297/188.04 |
| 3,374,032 | 3/1968 | Del Giudice . | |
| 3,666,319 | 5/1972 | Moloney, Jr. . | |
| 3,877,747 | 4/1975 | Brennan . | |
| 3,951,448 | 4/1976 | Hawie . | |
| 4,536,027 | 8/1985 | Brennan | 297/146 |
| 4,541,133 | 9/1985 | Reiss et al. . | |
| 4,558,901 | 12/1985 | Yokoyama . | |
| 4,571,756 | 2/1986 | Castro et al. . | |
| 4,579,384 | 4/1986 | Sharod . | |
| 4,601,515 | 7/1986 | Hatsutta et al. . | |
| 4,779,923 | 10/1988 | Lang et al. . | |
| 5,064,244 | 11/1991 | Sproule . | |
| 5,104,182 | 4/1992 | Rasnick et al. . | |
| 5,303,976 | 4/1994 | Nobile . | |
| 5,322,344 | 6/1994 | Hoffman et al. . | |
| 5,374,108 | 12/1994 | Saul et al. . | |
| 5,375,907 | 12/1994 | Rogers et al. . | |
| 5,397,167 | 3/1995 | Fourrey et al. | 297/354.13 |
| 5,524,959 | 6/1996 | Scott . | |
| 5,527,095 | 6/1996 | Marshall et al. | 297/270.1 |
| 5,531,506 | 7/1996 | Scott . | |
| 5,588,710 | 12/1996 | Wiecek | 297/463.1 |

FOREIGN PATENT DOCUMENTS

| | | |
|---|---|---|
| 0630880 | 5/1936 | Germany . |
| 284491 | 2/1928 | United Kingdom . |
| 327905 | 4/1930 | United Kingdom . |
| 438897 | 11/1935 | United Kingdom . |

*Primary Examiner*—Joseph J. Hail, III
*Attorney, Agent, or Firm*—Harness, Dickey & Pierce, P.L.C.

[57] ABSTRACT

A modular "bridge" section is disclosed having a seat frame assembly and a detachable seat back assembly supported therefrom. The seat frame assembly and the detachable seat back assembly are upholstered to define an aesthetically pleasing seat section which can be installed between two seat sections or, alternatively, which can be used as an armless end unit of a modular sectional arrangement. The detachable seat back assembly is further defined by an improved linkage mechanism for use with a retractable or "flip-down" sofa table comprising a pair of pivotable links, a centerboard mounted on one set of the links, and an upholstered cover which covers and aesthetically conceals the linkage mechanism and centerboard from view. Counterbalance means are provided to assist movement of the table between open and closed position.

37 Claims, 7 Drawing Sheets

SOFA BRIDGE

CROSS REFERENCE TO RELATED APPLICATION

This is a continuation of U.S. patent application Ser. No. 08/387,107, filed Feb. 10, 1995, now abandoned, which is a continuation-in-part of U.S. Ser. No. 322,790 filed Oct. 13, 1994, now abandoned, which is a continuation-in-part of U.S. Ser. No. 958,944 filed Oct. 9, 1992 which is now U.S. Pat. No. 5,374,108.

FIELD OF THE INVENTION

The present invention relates generally to upholstered articles of furniture and, more particularly, to an unobtrusive and aesthetically pleasing retractable sofa table having an improved linkage mechanism for use in modular seating units and sofas.

BACKGROUND OF THE INVENTION

The furniture industry has experienced a number of substantial competitive challenges in recent years. Many consumers have responded favorably to articles of furniture providing a wider range of convenience and functionality to the seat occupant. A number of these articles of furniture have been known to incorporate various comfort or function features, such as storage compartments and sofa tables into the seat sections of otherwise traditional articles of furniture. One such article of furniture relates to a sofa having a retractable sofa table which folds from a collapsible storage position within a recessed area of the sofa to a horizontal position resting just above or upon the seating surface of the sofa, where it is used as a table surface for beverages, reading material, and the like. Typically, the movement of the retractable sofa tables found in the prior art is facilitated by a some form of linkage mechanism that is attached to both the sofa table and some solid support in either the backrest or frame of the sofa. For example, U.S. Pat. No. 5,104,182 by Rasnick et al. discloses a linkage mechanism comprising a pair of links mounted to either side of the movable backrest section and includes an opposed recess and detent which snap engage for frictionally retaining the table in an open, substantially horizontal position, yet which becomes releasably disengaged in response to the application of loads on the table which exceed a predetermined value. Further, U.S. Pat. No. 5,322,344 by Hoffman et al. relates to a mechanism particularly suited for use with a sofa also housing an attached foldable bed. The Hoffman '344 mechanism comprises a pivotally interconnected upper and lower pivotal link where the lower pivot link is disclosed to include a bend between its pivots disposed toward the upper pivot link within which the head portion of the foldable bed can reside when the sofa table is in a closed position.

However, while the sofa table mechanisms known in the art provide a table-like surface for the seat occupant, they include linkage mechanisms that are often cumbersome and difficult to physically manipulate. Further, numerous prior art devices leave exposed linkage members for view which are both unattractive and undesirably accessible to children or other seat occupants. In addition, the mechanisms known to date often detract from the overall continuity of appearance of the sofa and can damage the fabric of a garment worn by the seat occupant.

A further area of shortcomings involving the linkage mechanisms found in the prior art relates to the pivotal links themselves. Because the links are designed to be retractable, they often fail to employ adequate stop means to place the table in a fixed position. Thus, for example, when the sofa table is in the open or horizontal position there is an increased likelihood that the sofa table will rotate beyond the horizontal point, thereby spilling the contents of the table.

Moreover, prior art mechanisms are designed so that the thickness of the sofa table, including the table surface itself as well as the cushioned upholstered surface viewable to the seat occupant, is somewhat limited. Such mechanism designs restrict the use of sofa tables to certain styles of sofas where cushions of relatively reduced size are used for the upholstered backrest. Hence, a linkage mechanism incorporating retractable links which collapse in a thinner profile within the seat back can accommodate and allow for greater freedom of design of the seat back cushion. This freedom of design is contemplated to include a wider array of comfort features to the seat occupant, such as a seat back cushion having more padding, springs, upholstery, or the like. Further, it will be appreciated that a linkage mechanism employing a thinner profile also serves to preserve the traditional aesthetic character of the article of furniture. For example, when the table member is placed in the upright or closed position, the thinner profile of design capability allows use of a seat back cushion of substantially identical, shape, comfort, and consistency to the adjacent seat back cushions on the same modular seating unit. This has the effect of preserving the continuity and flow-lines of the overall article of furniture as well as making the entire seating unit fully functional and equally comfortable to the seat occupant whether sitting on a section including the table member or a section not having the table member. It will be appreciated that the stop means or limit means of the present invention also operate to provide rigidity and secure placement of the table member in the seat back when the table member is in the upright closed position. This function of the stop or limit means allows for fixed and solid placement of the table member in the seat back and prevents the table member from inadvertent movement between the upright closed position and the horizontal open position.

SUMMARY OF THE INVENTION

The present invention obviates the above mentioned drawbacks and shortcomings of the prior art by providing a modular sofa "bridge" section having a stationary seat frame assembly and detachable seat back assembly supported therefrom. The seat back assembly includes an upholstered seat back member that can be detachably secured to the seat frame assembly. Further, the seat back assembly also includes an upholstered "flip-down" table member and centerboard having an attractive upholstered cover which are interconnected for pivotable articulated movement with respect to the upholstered seat back member by a pair of laterally but inwardly-spaced linkage mechanisms. The linkage mechanisms are self-supporting and synchronously operable to move the table member between a "closed" upright position and an "open" horizontal position with respect to the seat back member. The linkage mechanisms include stop means or limit means for positively locating the table member in either of the "open" and "closed" positions. The centerboard and the linkage mechanisms each serve to increase the rigidity of the table member when in the horizontal open position. This increased rigidity serves to add stability to the table member thereby decreasing the possibility of spilling the contents of the table member. An attractive upholstered cover is further provided to cover the inwardly spaced linkage mechanisms and centerboard from direct view of the seat occupant when the table member is in the horizontal open position. Further, when the table is in the "closed" position, a seat back cushion secured to a front portion of the table member acts to unobtrusively conceal the table member from view thereby preserving the continuity, appearance and traditional character of the sofa.

Accordingly, it is a principal object of the present invention to provide a modular "bridge" section having a seat frame assembly and detachable seat back assembly supported therefrom wherein the seat back assembly is further defined by an aesthetically pleasing "flip-down" sofa table and centerboard portion synchronously operable by a pair of laterally-spaced linkage mechanisms which serve to move the sofa table and centerboard portion between an unobtrusive "closed" upright position and a functional "open" horizontal position with respect to the seat back member. The centerboard portion, in operative movement with the linkage mechanisms, also serves to provide armrest functions and to increase the rigidity of the table member itself from side-to-side movement.

Another object of the present invention is to provide a pair of linkage mechanisms which are fully concealed when the "flip-down" sofa table and centerboard portion are placed in the "open" horizontal position.

A further object of the present invention is directed toward linkage mechanisms which include stop means for positively locating the table member in the "open" position thereby reducing the possibility of spilling contents of the sofa table onto either the seat occupant or upholstered portions of the sofa. It will be appreciated that the stop means of the present invention also operate to provide rigidity and secure placement of the table member in the seat back when the table member is in the upright "closed" position. This function of the positive stop means allows for fixed and solid placement of the table member in the seat back thus giving the seating unit the same comfort and feel as sitting in a seating unit not having a fold down table member.

Yet another object of the present invention is to provide a seat back assembly having a "flip-down" table that is self-supporting for sustaining large loadings without reliance on support from the underlying seat cushion.

A still further object of the present invention is to provide a "flip-down" sofa table which, in the retracted or "closed" position, allows for placement of an upholstered seat back cushion of equal thickness throughout the entire sofa affording greater comfort to the seat occupant.

An additional object of the present invention is to provide an attractive and aesthetically pleasing upholstered cover member which is positioned over the centerboard and a portion of the sofa table. The cover member not only serves to conceal portions of the linkage mechanism from the view of the occupant, but also serves as an auxiliary armrest and, in conjunction with the centerboard, enhances the contours of the overall sofa.

A still further object of the present invention is to provide a linkage mechanism with a counter-balance means which assists the over-center movement of the table member from the upright "closed" position to the horizontal open position and back again.

Yet another object of the present invention is to provide a linkage mechanism for a retractable sofa table having the capability of limiting the range of movement of the table member relative to the sofa frame beyond the horizontal open position thereby enhancing the rigidity of the table member when used by the seat occupant. The limiting range of movement also serves to secure table member in the upright closed position in abutment with the seatback thereby preventing inadvertent movement of the table member and linkage mechanism when in the closed position.

A still further object of the present invention is to provide a spring assisted linkage mechanism for use with a sofa table utilizing the tension and stored energy characteristics of a coil spring to assist in the over-center movement of the sofa table from an upright closed position and a horizontal open position.

Yet another object of the present invention relates to a spring assisted linkage mechanism having a predetermined configuration in a first link connecting the coil spring and linkage mechanism assembly which impacts the amount of tension and stored energy of the coil spring as the coil spring assists in the movement of the sofa table from an upright closed position to a horizontal open position.

Still another object of the present invention is to provide a counter-balanced linkage assembly in a sofa table arrangement that cushions movement of the table and counteracts gravitational forces which otherwise tend to cause the table to "fall" into position during the latter portions of its travel to the "open" and "closed" positions.

Additional objects, advantages, and features of the present invention will become apparent to one skilled in the art from the following description and appended claims, taken in conjunction with the accompanying drawings.

BRIEF DESCRIPTION OF THE DRAWINGS

FIGS. 1–13 are various views of an exemplary sofa having a "bridge" section that is equipped with a detachable seat back assembly having a "flip down" table member and of various embodiments of the mechanism for the "flip down" table. FIGS. 1–9 were depicted and disclosed in commonly owned U.S. Ser. No. 958,944 filed Oct. 9, 1992 now U.S. Pat. No. 5,374,108, and/or in U.S. Ser. No. 322,790 filed Oct. 13, 1994.

FIG. 3 is a perspective view of the upholstered bridge section showing means for releasably securing the seat back assembly to the seat frame assembly.

FIG. 4 is a top elevation view, taken generally along the circled portion of FIG. 2, illustrating a linkage mechanism used for coupling the table member to a stationary portion of the seat back assembly.

FIG. 5 is a side elevational view of the bridge section, with its upholstery and underlying padding and springs removed for purposes of clarity, showing the seat back assembly in the horizontal or "open" position.

FIG. 6 is a side elevational view of a second embodiment of the present invention utilizing an upper "flip-down" seat cushion showing the seat back assembly in the upright or "closed" position.

FIG. 7 is a side elevational view, similar to FIG. 6, showing the linkage mechanism and "flip-down" seat cushion horizontal or "open" position.

FIG. 8 is a partial enlarged view of the linkage mechanism of the present invention in the horizontal or "open" position.

FIG. 9 is a partial enlarged view of the linkage mechanism of the present invention in the upright or "closed" position.

FIG. 11 is a side elevational view of a third embodiment of the present invention showing the counter-balancing spring assisted linkage mechanism and table member in the "open" or horizontal position.

FIG. 10 is a side elevational view of the third embodiment of the present invention showing the counter-balancing spring assisted linkage mechanism and table member in the upright or "closed" position.

FIG. 12 is a top elevation view of the third embodiment of the present invention depicted in an intermediate position wherein the table member is in the process of being moved between an upright "closed" position and horizontal "open" position.

FIG. 13 is a partial enlarged side view of the spring assisted linkage mechanism in the intermediate position of FIG. 12.

DETAILED DESCRIPTION OF THE PREFERRED EMBODIMENT

Figure 1:
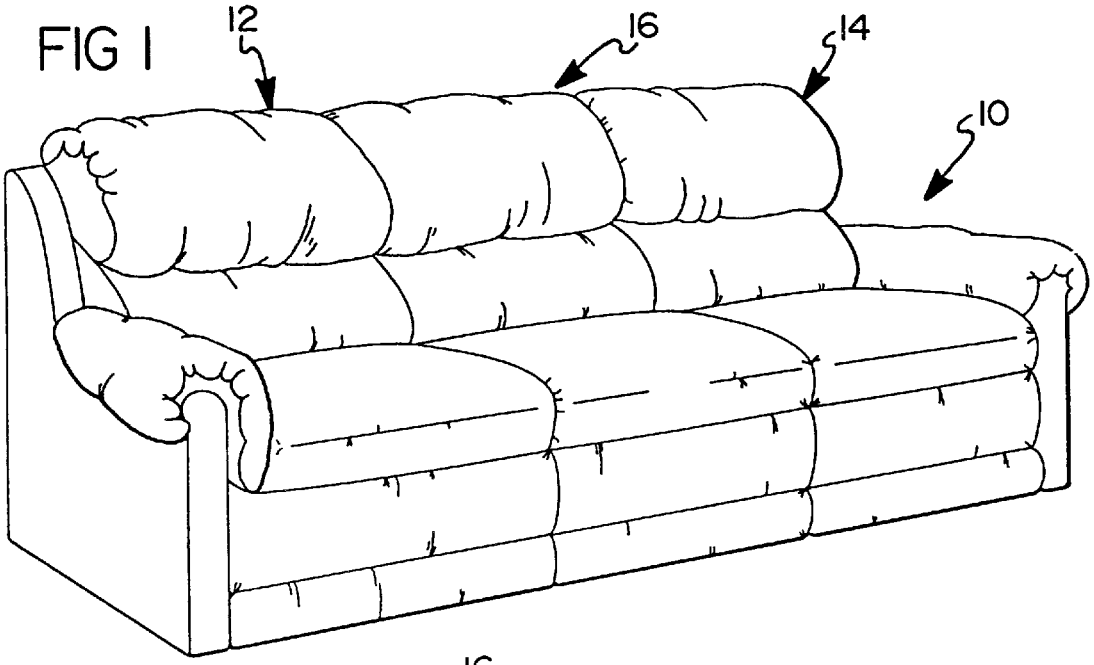
FIG. 1 is a perspective view of an exemplary sofa having a "bridge" section that is equipped with a detachable seat back assembly having a "flip-down" table member shown in a normally upright or "closed" position.
Figure 2:
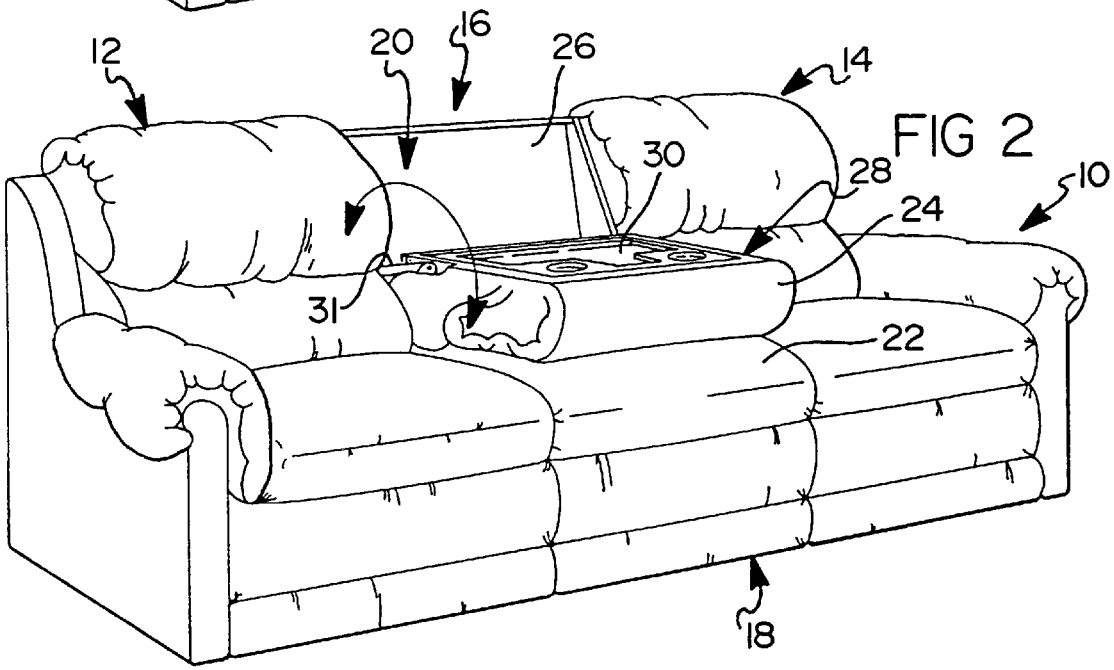
FIG. 2 is a perspective view, similar to FIG. 1, showing the table member of the seat back assembly in a horizontal or "open" position.

With reference to the drawings, an exemplary upholstered sofa 10 is shown in FIGS. 1 and 2 to include right and left seat sections 12 and 14, respectively, and a bridge section 16 therebetween. In general bridge section 16 is a dual-purpose unit having a "flip-down" table incorporated into the seat back that can be selectively concealed or operatively extended. Thus, when the "flip-down" table is extended, bridge section 16 functions as a console unit to provide a combination arm rest and table surface.

Preferably, seat sections 12, and 14 and bridge section 16 are manufactured as separate upholstered units which can be rigidly assembled into sofa 10 in the manner disclosed in commonly owned U.S. Pat. No. 5,234,253, issued Aug. 10, 1993, or U.S. Ser. No. 08/109,832 filed Aug. 20, 1993, both entitled "Mounting Apparatus For A Modular Sofa Assembly", or in U.S. Ser. No. 08/209,159, filed Mar. 10, 1994 and entitled "Mounting Apparatus For Securing Independent Sections Of A Sectional Sofa Assembly" the disclosure of which are all expressly incorporated by reference herein. Alternatively, bridge section 16 is also well-adapted for use with modular sectional units so as to be positionable as either an intermediate unit or as an armless end unit. While not forming part of the present invention, it is contemplated that seat sections 12 and 14 could include such comfort features as reclining seat assemblies and/or extensible leg rest assemblies.

Figure 3:
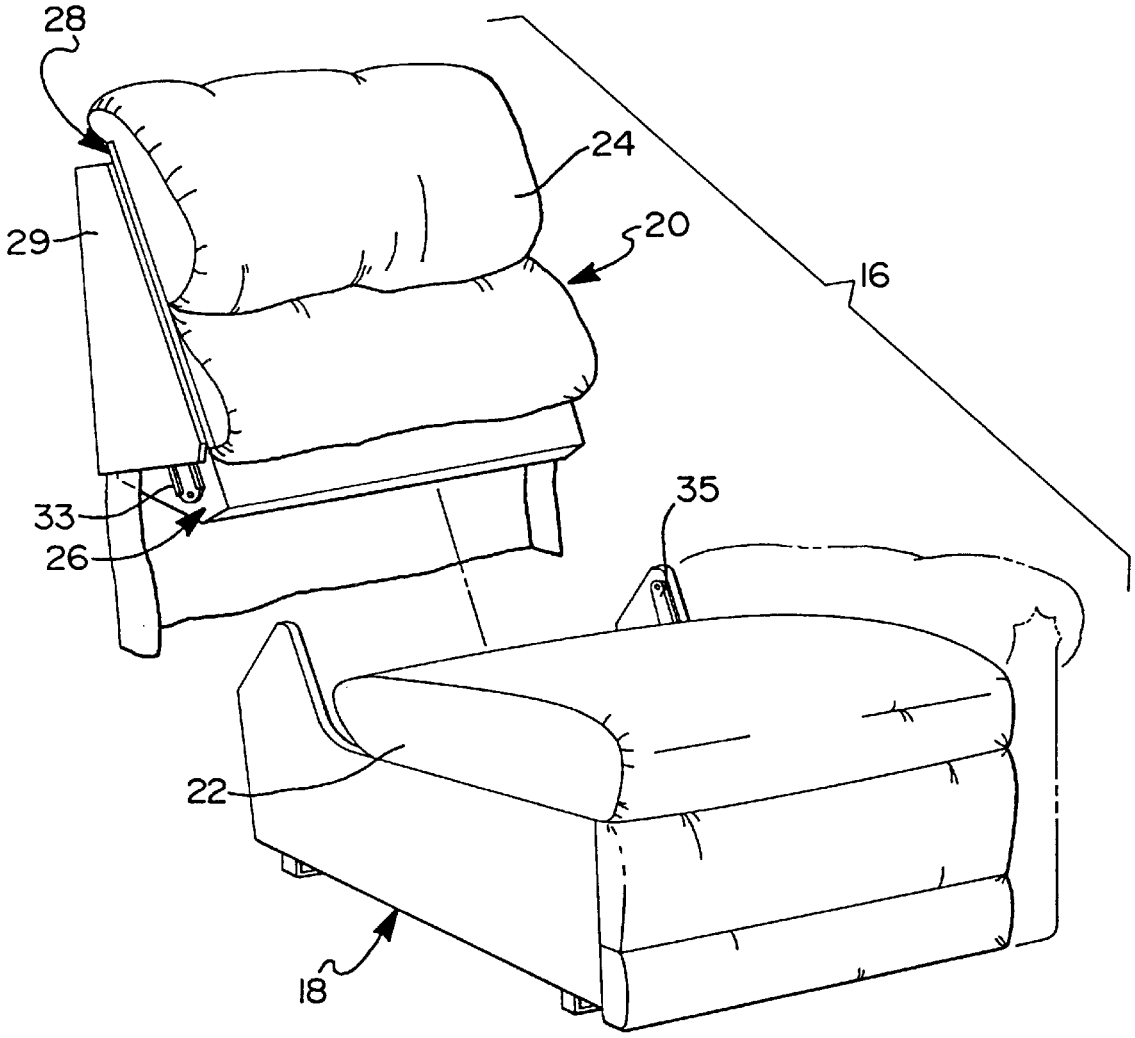
Figure 4:
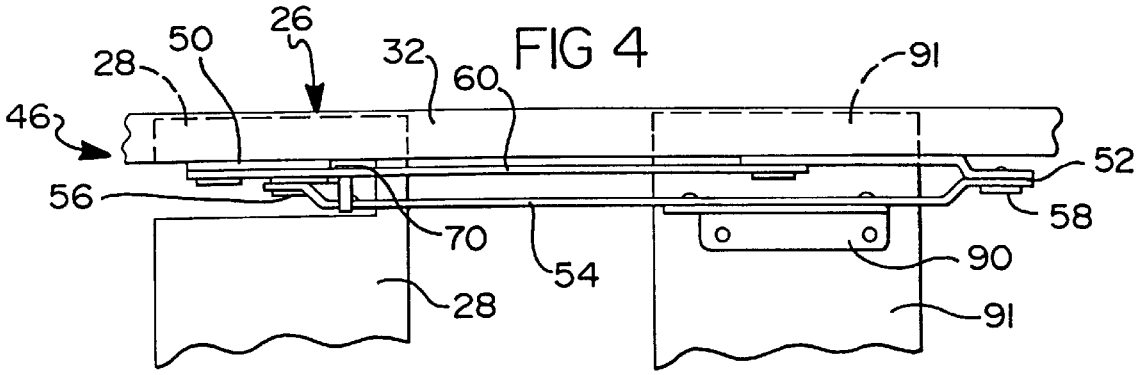

As best seen from FIGS. 1 through 3, bridge section 16 is shown to generally include an upholstered seat frame assembly 18 and an upholstered seat back assembly 20. Seat frame assembly 18 is a rigid box-like structure that is adapted to support a seat cushion 22 thereon while seat back assembly 20 carries a seat back cushion or cushioned back 24. In accordance with the present invention, seat back assembly 20 includes a stationary back member 26 and a "flip-down" table member 28. Table member 28 is movable with respect to back member 26 between an upright "closed" position (as shown in FIG. 1) and a horizontal "open" position (as shown in FIG. 2). Cushioned back 24 is carried on a front portion of table member 28 while a multi-purpose tray 30 is secured to a rear portion thereof. Thus, it will be understood that in the upright "closed" position, tray member 30 is concealed from view while cushioned back 24 maintains the overall continuity (i.e., "flow lines") of sofa 10. Moreover, it can be seen that in the horizontal "open" position, table member 28 also functions as a inboard armrest for a person seated in either of seat sections 12 and 14.

According to one desirable feature of the present invention, a pair of lockable slide brackets 33 are secured to lateral edge portions of back member 26 and can be inserted over links 35 secured to seat frame assembly 18 for detachably securing seat back assembly 20 to seat frame assembly 18 in a manner similar to that disclosed in commonly owned U.S. Pat. No. 5,184,871, issued Feb. 9, 1993 and entitled "Detachable Chair Back" the disclosure of which is likewise incorporated by reference herein. Thus, the present invention is superior to conventional console arrangements in that detachable seat back assembly 20 can be retrofitted into existing sofas and sectional units. In this manner, an otherwise conventional backrest can be replaced with detachable seat back assembly 20 to provide the added comfort and convenience offered by "flip-down" table member 28.

With reference to FIGS. 4 through 9 wherein bridge section 16 is shown in some instances with its upholstery and underlying support structure removed, the functional cooperation of the various components associated with detachable seat back assembly 20 will now be described in greater detail. In general, the inner frame construction for each of back member 26 and table member 28 is conventional in nature and includes wooden beams interconnected using suitable fasteners, adhesives and the like. In particular, back member 26 has a rigid frame structure made of a pair of laterally-spaced vertical side rails 32 that are secured along their lower portions by a pair of transverse cross members 36. Back member 26 further includes a down-turned U-shaped segment having vertical side beams 38 that are interconnected by an upper cross member 40. To provide rigidity, the inner planar surfaces of vertical side beams 38 overlay the outer planar surfaces of vertical side rails 32 and are secured thereto via attaching means, such as suitable fasteners and/or adhesives, to form a generally box-like back member 26. As best in FIG. 5, the laterally-spaced vertical side rails 32 are generally triangular and have a forwardly extending lower lug 42 between which cross member 36 is secured. More particularly, a front edge 44 of side rails 32 is tapered to extend forwardly so as to define an enlarged open area within back member 26 between lower cross members 36.

To provide means for permitting table member 28 to move between the "closed" and "open" positions with respect to back member 26, a pair of laterally-spaced linkage mechanisms 46 are provided. More specifically, the laterally-spaced linkage mechanisms 46 are operable for coupling an inner box-like frame 48 of table member 28 to vertical side rails 32 of back member 26. While only one linkage mechanism 46 is shown and described in detail, it will be understood that a mirror image linkage mechanism on the opposite lateral side of seat back assembly 20 works in synchronization therewith.

Figure 7:
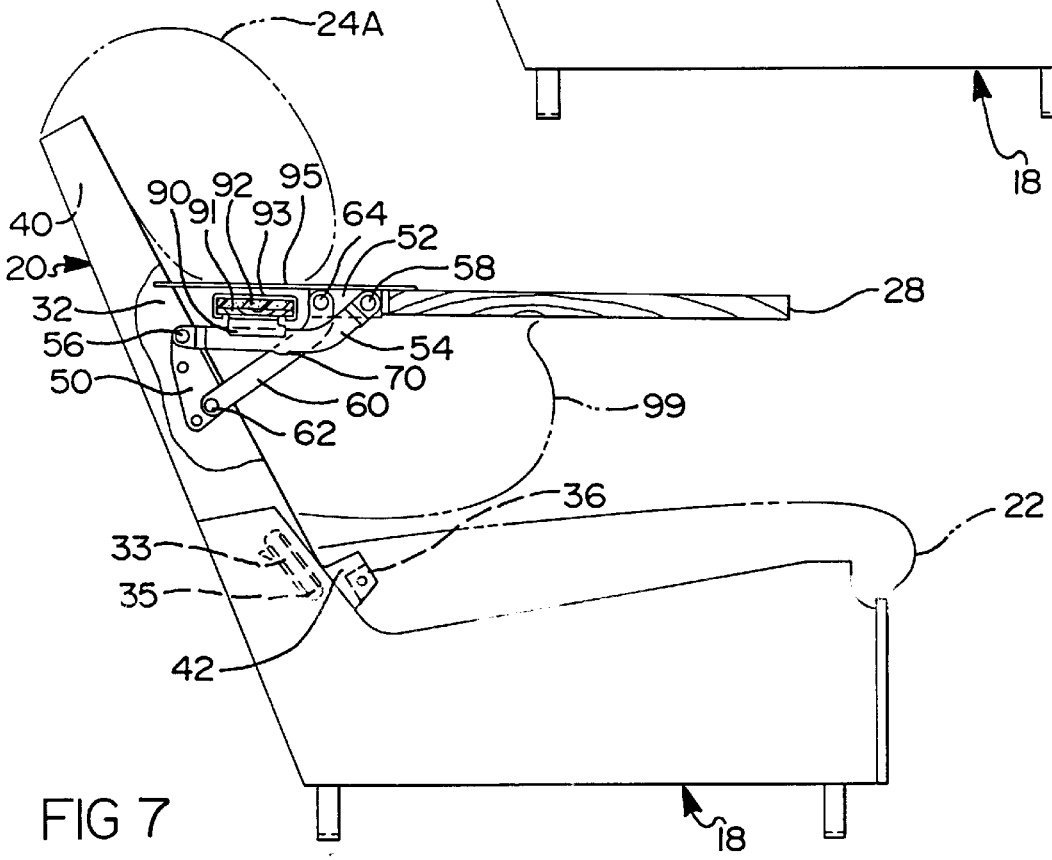
Figure 8:
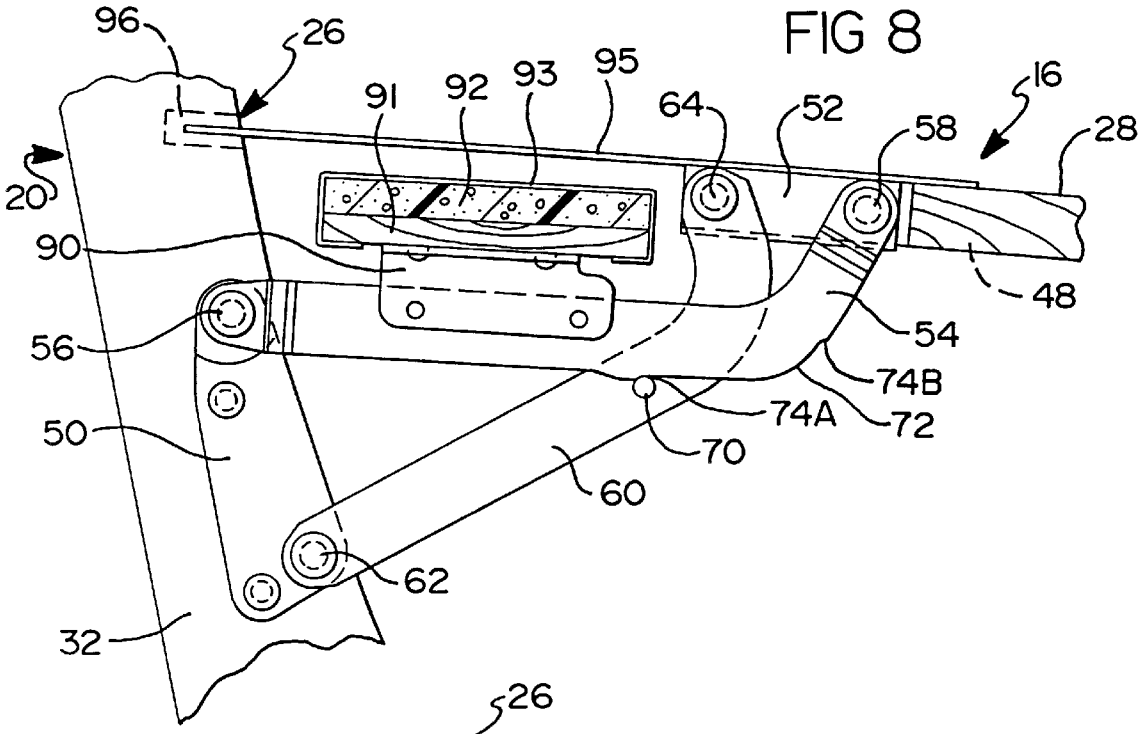

According to a first embodiment, each linkage mechanism 46 is a four-bar linkage that is adapted to generate articulated pivotable movement of table frame 48. As best seen from FIGS. 8 and 9, each linkage mechanism 46 includes a first pivot bracket 50 mounted to an external planar surface of side rail 32 and a second pivot bracket 52 mounted to an external edge surface of table frame 48. An upper swing link 54 has its first end pivotably connected about pivot point 56 to an upper end of first pivot bracket 50. The opposite end of upper swing link 54 is pivotably coupled about pivot point 58 to a portion of second pivot bracket 52. In addition, a first end of a lower swing link 60 is pivotably coupled about pivot point 62 to a lower portion of first pivot bracket 50. The second end of lower swing link 60 is pivotably coupled about pivot point 64 to an end portion of second pivot bracket 52 secured in close proximity to a rear edge of table frame 48. Preferably, each of the afore-noted pivot points is defined by a riveted connection between the respective pivot bracket and swing link. As best shown in FIGS. 7 and 8 the linkage mechanism 46 is configured to be attached to table member 28 inboard from the lateral edges of table member 28. Due to the inboard location of its attachment, upper an lower swing links 54 and 60 are configured to comprise a bend or curve therein near their table member ends that allows the links 54 and 60 to approach table member 28 from below its horizontal surface (when in the "open" position) for attachment to second pivot bracket 52. This inboard location substantially conceals the linkage mechanisms 46 and substantially reduces accessibility to any pivot points associated with the articulated movement of the linkage mechanism, thereby eliminating the need for shielding found in other prior known sofa tables.

To provide means for positively locating and supporting table member in the "open" position, a stop rivet 70 is fixed to lower swing link 60 and is engageable with an edge surface of upper swing link 54. More particularly, the lower edge surface of upper swing link 54 has a "carved-out" slot 72 which terminates at each end with generally arcuate surfaces 74A and 74B. Thus, in the horizontal "open" position shown in FIG. 8, the arcuate outer peripheral surface of stop rivet 70 is adapted to matingly engage arcuate surface 74A formed at one end of carved-out slot 72 so as to maintain a continuous "line" of contact therebetween. Such a locking arrangement provides superior stability and rigidity for supporting table member 28 in the "open" position. More specifically, with table member 28 in the "open" position, the positive stop means associated with linkage mechanisms 46 permit table member 28 to withstand static loads that are greater than those anticipated from normal use. The above described stop rivet 70 also allows for a locking arrangement which provides superior stability and rigidity for supporting table member 28 in the upright "closed" position. In this manner, the stop rivet 70 interacts with generally arcuate surfaces 74A and 74B to provide fixed and solid placement of the table member 28 in the upright "closed" position regardless of whether the table member 28 itself abuts against any framing member of the stationary back member 26. Thus, the cushioned back 24 will have the same solid comfort and feel of a cushioned back seating unit of a seating unit not having a folding table member 28. It is additionally contemplated that stop rivet 70 can comprise a formed enlarged head at the end of the stop rivet 70 which would serve to prevent the links from inadvertently moving or sliding past each other when excess loadings are placed on the table member 28.

Figure 9:
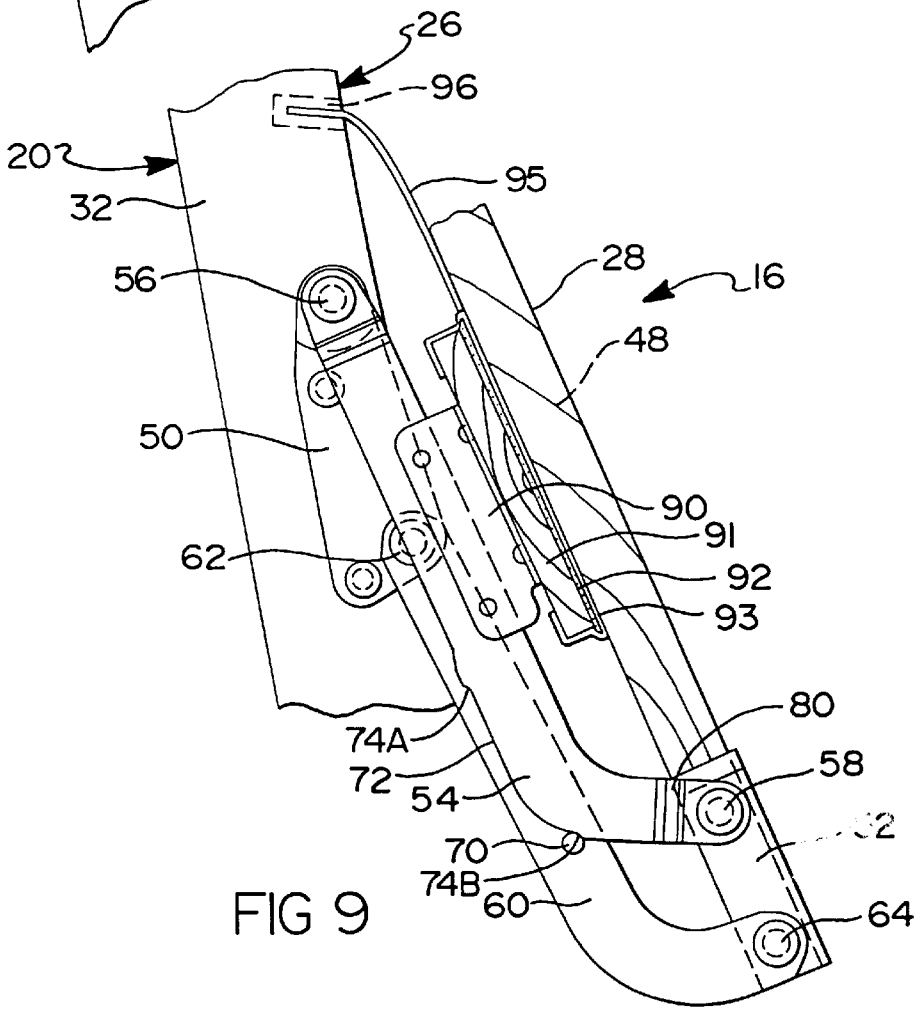

As best seen from FIG. 9, when table member 28 is positioned in its upright "closed" position, linkage mechanism 46 is arranged such that the opposite end 74B of carved-out slot 72 engages the peripheral surface of stop rivet 70. Thus, the present invention is adapted to provide means for positively locating table member 28 in either of the upright "closed" position or the "open" horizontal position. Due to the compact arrangement inward location (from the edges of table member 28), and articulated movement of linkage mechanisms 46, the linkage mechanisms 46 are completely concealed when table member 28 is in the "closed" position and are substantially concealed when table member 28 is in the "open" position.

The present invention also comprises a centerboard mounting bracket 90 retainingly mounted to the upper swing link 54 and a centerboard 91 mounted to the centerboard mounting bracket 90. It is contemplated that the centerboard 91 would have an upper padded portion 92 comprising fabric, foam, poly material, or the like and having an upholstered cover portion 93 which covers the upper padded portion 92 and is retainingly secured to the underside of the centerboard 91. The centerboard 91 is mounted on each of the first links 54, interconnecting the two linkage mechanisms 46 and providing rigidity to them and the table member 28. It is further contemplated that the centerboard 91 alternatively could comprise a formed bar constructed out of metal to provide increased strength and rigidity. The ends of this formed bar centerboard may be configured to overlap or overhang the exposed links 54, 60 and be attached to the links by securing means. In addition, the present invention further comprises an upholstered cover 95 retainingly secured to the seat back member 26 by attaching means 96 securing the upholstered cover 95 in the seat back 26 at one end and retainingly mounted to the table member 28 at an opposite end. The upholstered cover 95 provides a continuous fabric cover supported by the upholstered cover portion 93 and upper padded portion 92 of the centerboard 91. The upholstered cover 95 articulates with the pivotable movement of the linkage mechanism 46 to prevent wrinkling or bunching of the cover 95 so that the cover 95 remains taunt when in the extended horizontal position in conjunction with the table member 28 in the "open" position and neatly folded in a retracted position when the table member is in the upright "closed" position. The upholstered cover 95 not only affords a means to cover and conceal the linkage mechanism 46 and centerboard 91 from view of the seat occupant but also serves to work in conjunction with the centerboard to provide a comfortable and attractive arm rest for the seat occupant, whereby the centerboard 91 provides rigidity and support to the upholstered cover 95 as the upholstered cover 95 overlies the centerboard 91. As depicted in FIGS. 8 and 9, it is contemplated that the upper padded portions 92 and upholstered cover portion 93 of the centerboard 91 can be compressed when in the upright "closed" position, as seen in FIG. 9, depending upon the configuration of the links. In this manner, the upholstered cover portion 93 and upper padded portion 92 of the centerboard 91 serves to both provide rigidity to the upholstered cover 95 and allow the linkage mechanism 46 and table member 28 to collapse into substantially parallel relationship as seen in FIG. 9. It is contemplated that a variable gap could be placed between the upholstered cover portion 93 of the centerboard 91 and the upholstered cover 95. However, it will be appreciated that the size of this gap may vary depending upon the chosen thickness of the upper padded portion 92 of the centerboard 91.

Figure 5:
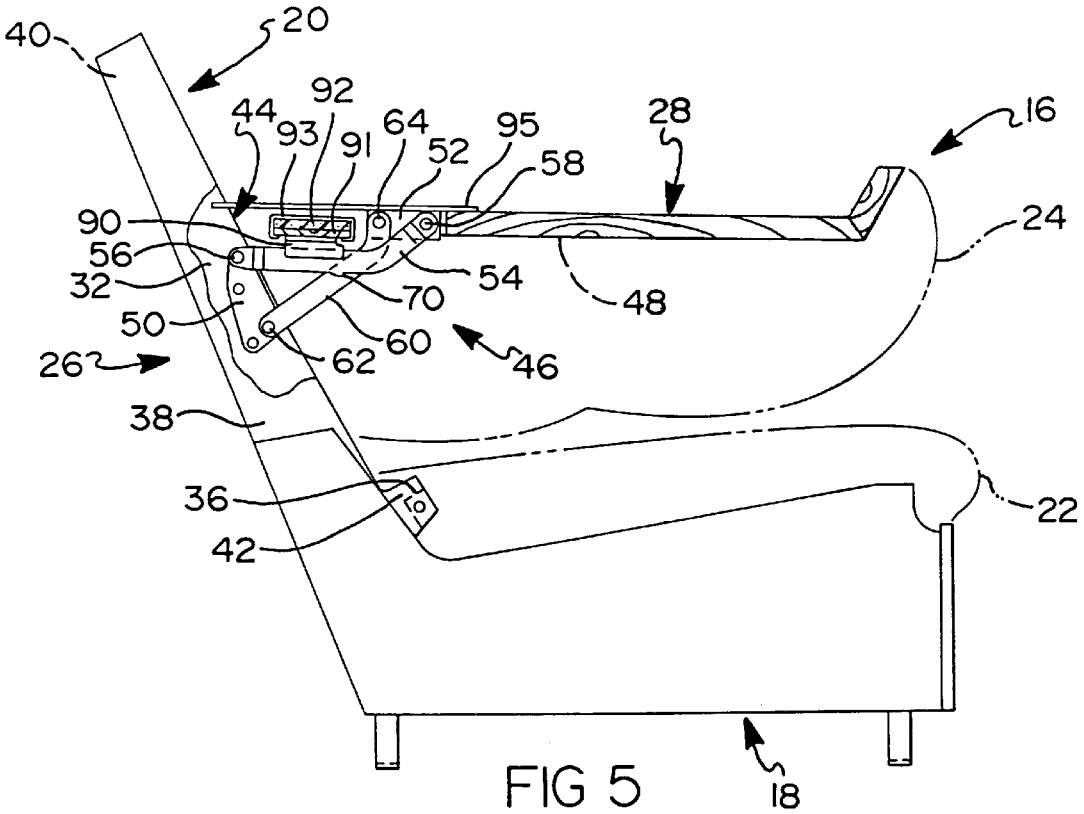

When it is desired to move the table member 28 from the normally "closed" position of FIG. 9, to the "open" position of FIGS. 5 and 8, an upper edge of the table member 28 is pulled forwardly and downwardly (i.e. clockwise in the drawings). Such movement causes both swing links 54 and 60 to swing upwardly about their respective pivot points on first pivot bracket 50. As such, the rear portion of table frame 48 is swung forwardly to maintain a clearance relative to the seat back member 26. Thereafter, continued movement of table member 28 causes pivot point 64 on the second end of lower link 60 to be driven upwardly for rotating second pivot bracket 52 and table frame 48 about pivot point 58 to the desired horizontal orientation. In this position, pivot point 64 is slightly over-center with respect to second pivot point 58 of upper swing link 54, such over-center positioning of pivot point 64 corresponding to engage stop rivet 70 with front arcuate end 74A of carved out slot 72. Also in this position, the centerboard 91 mounted on centerboard bracket 90 which is attached to upper swing link 54 is also placed in substantially horizontal orientation relative to the table member 28, the effect of which is a two-tier or "step"

assembly comprising the centerboard 91 and the table member 28, as seen in FIG. 5. As further seen in FIG. 5, an upholstered cover 95 retainingly mounted to the table member 28 is also unfolded following the rotative movement of the table member. The upholstered cover 95 provides a cover to conceal centerboard 91 and linkage mechanisms 46 and further serves to interact with the centerboard 91 whereby the centerboard 91 provides support and rigidity to the upholstered cover 95 when the seat occupant uses the upholstered cover as an arm rest.

Figure 6:
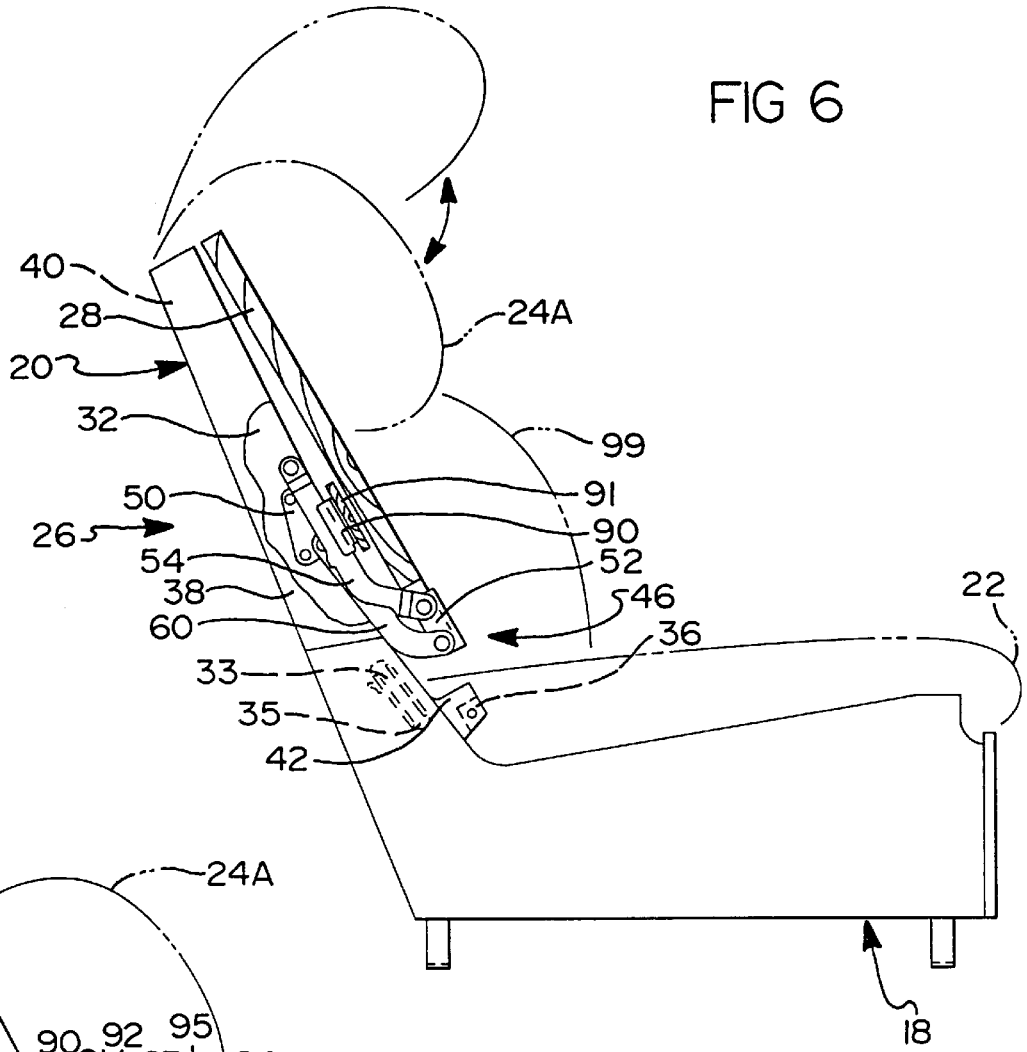

A second embodiment of the present invention is depicted in FIGS. 6 and 7 wherein the seat back assembly has a cushioned back 24 that is comprised of a "flip-down" upper cushion section 24A and a stationary lower cushion section 99. In this embodiment, the table member 28 is moved from the upright closed position to the horizontal open position by first physically lifting the "flip down" upper cushion section 24A to expose the table member 28 The upper cushion section 24A then rests upon the seat back assembly 20 while the table member 28 is moved from the upright closed position to the horizontal open position. The linkage mechanism 46 operates in the same way as described in the above previously described embodiment. Further, while not depicted in FIG. 6, the upholstered cover 95 is retainingly mounted to the table member 20 to cover the linkage mechanism 46, centerboard 91, centerboard upper padded portion 92, and upholstered cover portion 93, as seen in FIG. 7. The "flip-down" upper cushion section 24A is then physically moved down from its resting place above the seat back assembly 20 to its normal position in front of the seat back 20 where it abuts and rests upon the upholstered cover 95, thereby preserving the appearance of a traditional sofa.

A third embodiment of the present invention relates to a sofa 10 having an improved linkage mechanism 100 counter-balance means to assist in the over-center movement of table member 28. In a preferred form of this embodiment a coil spring 101 is utilized and provides spring assist or counterbalance and assist movement of the table member. As with the first embodiment, while only one linkage mechanism 100 is shown and described in detail, it will be understood that a mirror image linkage mechanism 100 on the opposite lateral side of seatback assembly 20 works in synchronization therewith. It is contemplated that the tension stored energy characteristics of the coil spring 101 in conjunction with the features of the linkage mechanism 100 will allow more stable, uniform movement of the table member 28, as well as preventing inadvertent movement of the table member from its stored position. The coil spring 101 further serves to bias the table member 28 for ease of articulated over-center movement between the upright closed position and the horizontal "open" position utilizing a plurality of pivot points, as depicted in FIGS. 10 and 11.

Figure 10:
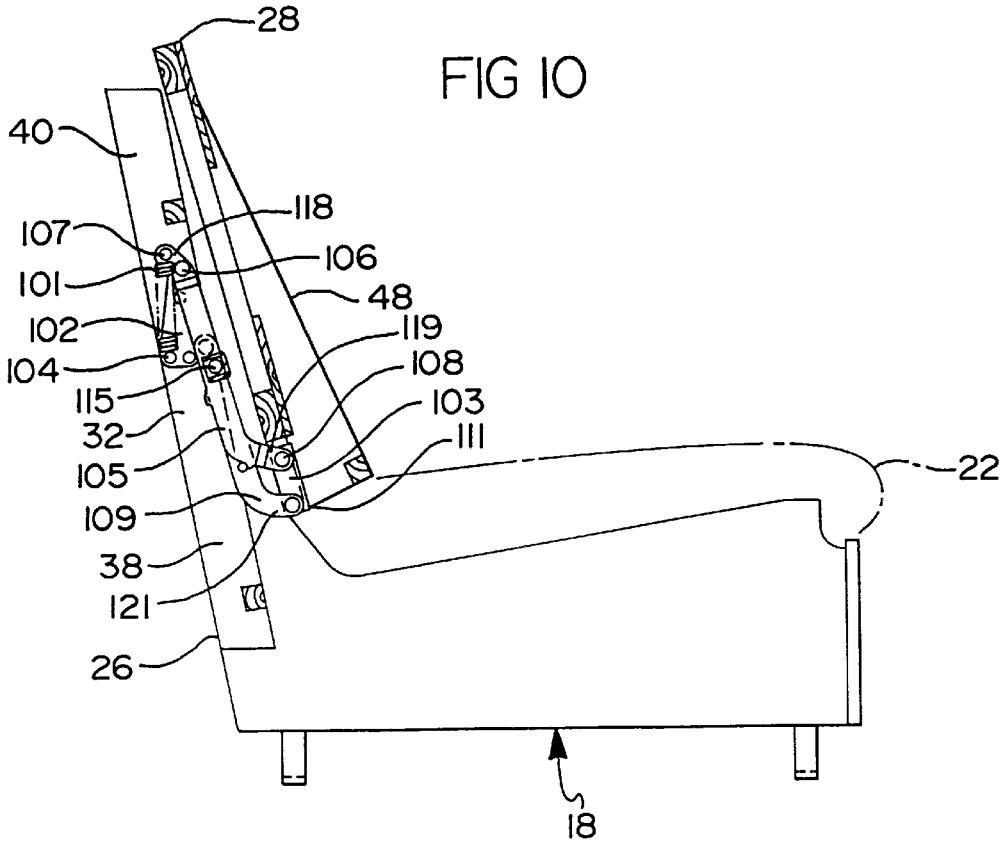
Figure 11:
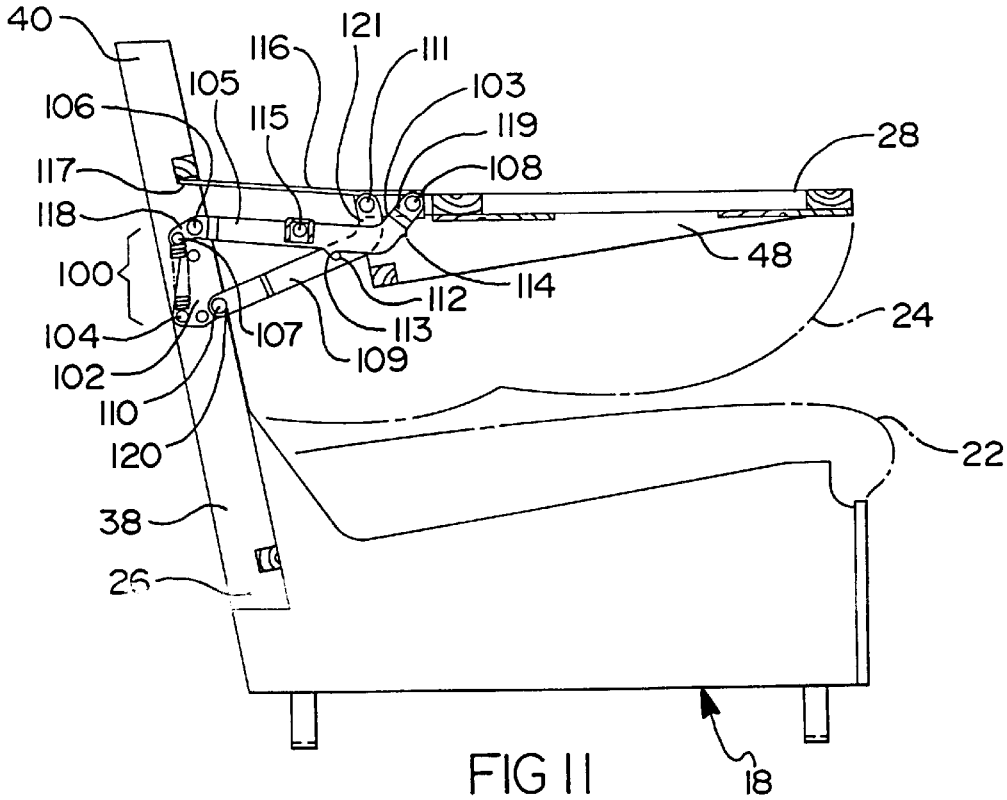

As further seen in FIGS. 10 and 11, the spring assisted linkage mechanism 100 of this embodiment is adapted for use with the sofa frame assembly 18 and seatback assembly 20 by a mounting bracket 102 mounted to an external planar surface of siderail 32 and a tray table or mounting bracket 103, mounted to an external edge surface of the table frame 48. A lower portion of the mounting bracket 102 is further characterized by having a longitudinally extending shoulder stud 104 which retainingly secures one end of the coil spring 101. An upper or first swing link 105 is intermediately pivotably connected about pivot point 106 to an upper end of mounting bracket 102 while a first end 118 of the upper swing link 105 is characterized by having a longitudinally extending shoulder stud 107 which further serves to retainingly secure an opposite end of the coil spring 101. According to particular features of the present invention the first end 118 of first link 105 embodies a curve or bend so that the longitudinally extending shoulder stud 107 is angled away from pivot point 106. It is contemplated that end 118 of the first link 105 can be configured to encompass a variety of curved ends thereby disposing longitudinal shoulder stud 107 first link 105 and pivot point 106 in a number of angular orientations. The opposite end 119 of the upper swing link 105 is pivotably coupled about pivot point 108 to a portion of the tray table or mounting bracket 103. In addition, a first end 120 of a second or lower swing link 109 is pivotably coupled about pivot point 110 to a lower portion of the mounting bracket 102. The opposite end 121 of the second link 109 is pivotably coupled about pivot point 111 to an end portion of the tray mounting bracket 103 secured in close proximity to a rear edge of table frame 48. Preferably, each of the afore-noted pivot points is defined by a riveted connection between the respective pivot bracket and swing link. As best shown in FIGS. 10 and 11, the linkage mechanism 100 is configured to be attached to table member 28 inboard from the lateral edges of table member 28. Due to the inboard location of its attachment, the first and second swing links 105 and 109 are configured to also comprise a bend or curve therein near their table member ends that allow the links 105 and 109 to approach table member 28 from below its horizontal surface (when in the "open" position) for attachment to the tray mounting bracket 103. This inboard location substantially conceals the linkage mechanisms 100 and substantially reduces the accessibility to any pivot points associated with the articulated movement of the linkage mechanism. 100, thereby eliminating the need for shielding found in other prior known sofa tables.

To provide means for positively locating and supporting table member in the "open" and "closed" positions, a longitudinally extending limit rod 112, is fixed to the second swing link 109 and is engageable with a first generally arcuate surface 113 of the first link 105 when the table member 28 is in the horizontal open position and with a second generally arcuate surface 114 when the table member 28 is in the upright closed position. Thus, in the open horizontal position shown in FIG. 11, the longitudinally extending limit rod 112, is adapted to matingly engage the first or upper arcuate surface 113 of the first link 105 so as to maintain a continuous "line" of contact therebetween. Such a locking arrangement provides superior stability and rigidity for supporting table member 28 in the "open" position. More specifically, with table member 28 in the "open", position such limit means associated with linkage mechanisms 100 permit table member 28 to withstand static loads that are greater than those anticipated from normal use. The above described longitudinally extending limit rod 112 also allows for a limiting arrangement which provides superior stability and rigidity for supporting table member 28 in the upright closed position. In this manner, the longitudinally extending limit rod 112 interacts with the second or lower arcuate surface 114 of the first link 105 to provide fixed and solid placement of the table member 28 in the upright closed position regardless of whether the table member 28 itself abuts against any framing member of the stationary seatback 26. Thus, the cushion back 24 will have the same solid comfort and feel of a cushion back seating unit of a seating unit not having foldable table member 28. It will be further appreciated that the longitudinally extending limit rod 112 in cooperation with the first and second arcuate surfaces of the first link 105 will inhibit inadvertent movement of the table member 28 while in either the horizontal "open" position or upright "closed" position.

When table member 28 is positioned in the upright "closed" position, linkage mechanism 100 is arranged such that the second arcuate surface 114 of the first link 105 engages the peripheral surface of the longitudinally extending limit rod 112 of the second link 109. Thus, the present invention is adapted to provide means for positively locating table member 28 in either of the upright "closed" or "open" horizontal positions. Due to the compact arrangement, inward location (from the edges of table member 28), and articulated movement of the linkage mechanisms, linkage mechanisms 100 are completely concealed when table member 28 is in the upright "closed" position and are substantially concealed when table member 28 is in the horizontal "open" position. As further seen in FIGS. 10–13, as the first link 105 pivots about pivot point 106, the articulated movement of the first link 105 causes the longitudinally extending shoulder stud 107, located at the end of the link 105 and configured in an angled relationship with respect to pivot point 106, to move upwardly and slightly rearwardly thereby causing the tension coil spring 101 that is retainingly secured by shoulder stud 107 to stretch and disproportionally extend thereby storing additional energy within the coil spring 101. As particularly seen in FIG. 10–13, the configuration of the first link 105 with respect to the angled first end 118 supporting the longitudinally extending shoulder stud 107 determines the amount of additional tension imparted to the coil spring 101. This offset configuration tension of the counter-balance coil spring 101 from pivot 106 allows for the over-centered movement of the linkage mechanism 100 when table member 28 is moved from the upright "closed" position to the horizontal "open" position. The coil spring 101 and stored energy therein serve to further assist the fixed placement of the table member 28 within the seatback assembly 20 in conjunction with the limit means until the table member 28 is moved into the horizontal "open" position at which time the counter-balance coil spring 101 and the stored energy therein assists in the over-center movement of the table member 28 with respect to pivot points 106, 108, 110 and 111 allowing a more ergonomic cushioned opening of the table member 28. It will be appreciated that the amount of stored energy associated with the coil spring 101 and over-centered movement of the linkage mechanism 100 is dependent on with the distance and configuration of the end 118 of the first link 105 cooperating with the longitudinally extending shoulder stud 107 retaining one end of the coil spring 101. In addition, coil springs 101 of differing strengths can be utilized to control the amount of counterbalance force provided by linkage mechanism 100. This ability to vary the amount and application of counterbalance force allows table member 28 to incorporate table tops of differing materials, having differing weights, such as solid wood composition and the like.

Figure 12:
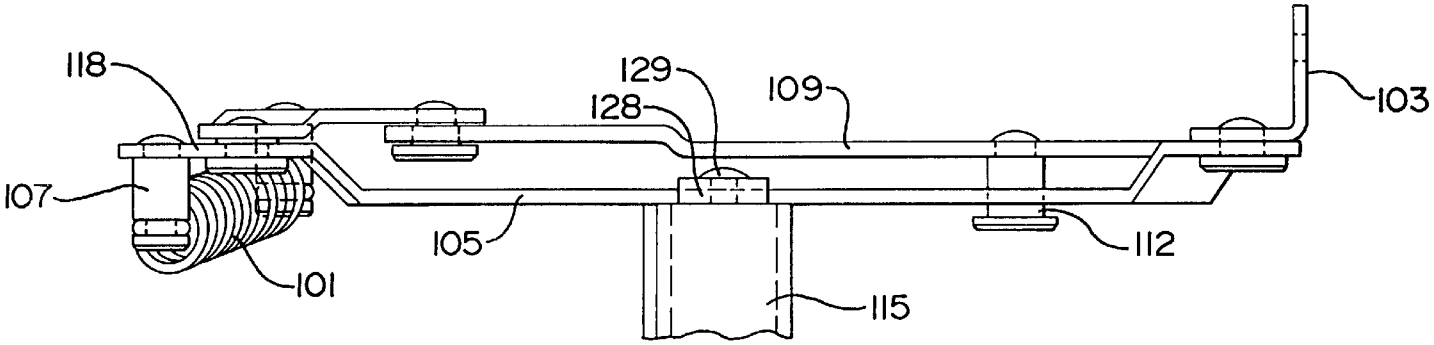
Figure 13:
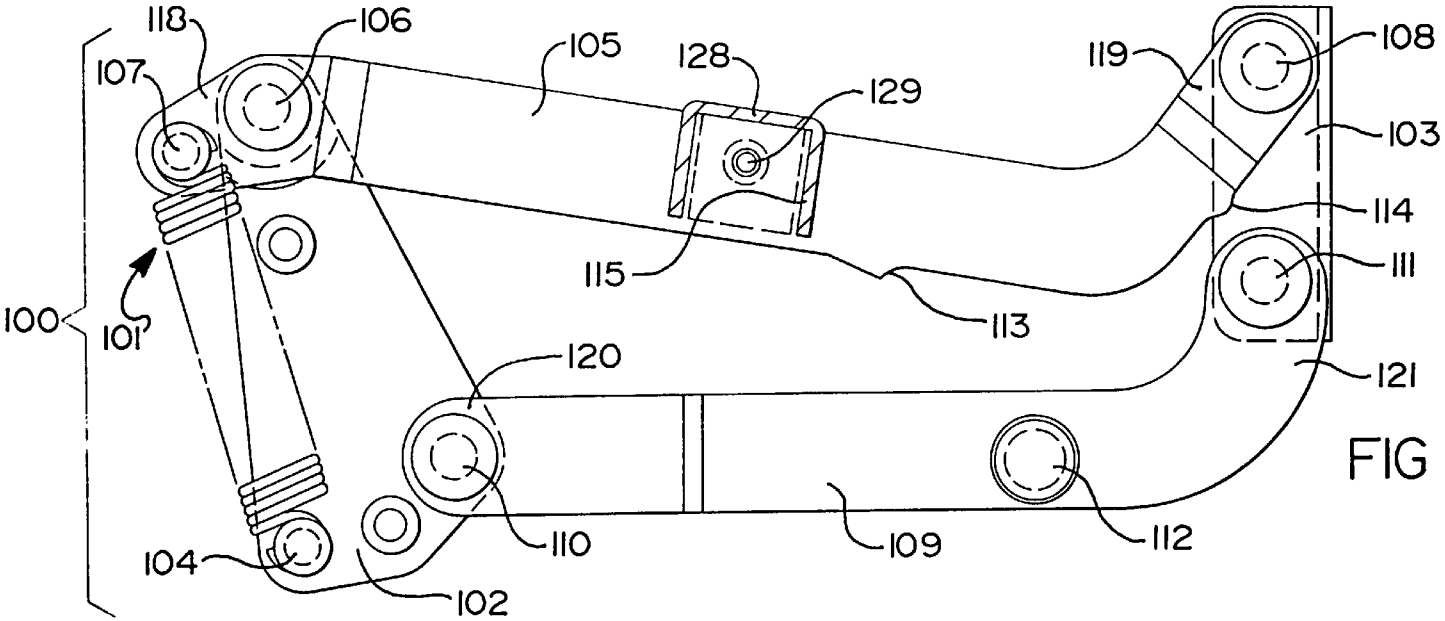

This embodiment further contemplates a center spacer bar 115 retainingly mounted to and between the first links 105 which substantially increases side to side rigidity of the linkage mechanisms 100 as well as the tab e member 28 itself. This increase in rigidity is due in part to the channel shaped cross section of bar 115. When the channel shaped cross section abuts first link 105 and entraps link 105 between the channel shaped cross section and the folded flange 128 and shown in FIGS. 12 and 13, a counterlevered joint is created that enhances rigidity of the joined members. As shown in FIGS. 12 and 13, center spacer 115 is fastened and first links 105 by a suitable fastener 129. Thus, the center spacer bar 115 is mounted between and on each of the first links 105, interconnecting the two linkage mechanisms 100 and providing rigidity to them and the table member 28. In addition, this embodiment further comprises an upholstered cover 116 retainingly secured to the seatback member 26 by attaching means 117. The cover 116 is secured to the seatback 26 at one end and retainingly mounted to the table member 28 at an opposite end, as shown in FIG. 11. The upholstered cover 116 articulates with the pivotable movement of the linkage mechanism 100 to prevent wrinkling or bunching so that the cover 116 remains taunt when in the extended horizontal position in conjunction with the table member 28 being in the "open" position, and neatly folded in a retracted position when the table member 28 is in the upright "closed" position. The upholstered cover 116 not only affords a means to cover and conceal the linkage mechanism 100 and center spacer bar 115 from view of the seat occupant, but also serves to work in conjunction with the center spacer bar 115 to provide a comfortable and attractive armrest for the seat occupant. In addition, the center spacer bar 115 provides rigidity and support to the upholstered cover 116.

When it is desired to move the table member 28 from the normally upright "closed" position, depicted in FIG. 10, to the horizontal "open" position of FIG. 11, upper edge of the table member 28 is pulled forwardly and downwardly (i.e. clockwise in the drawings). Such movement causes both links 105 and 109 to swing upwardly about their respective pivot points of the mounting bracket 102. As such, the rear portion of the table frame 48 is swung forwardly to maintain a clearance relative to the seatback member 26. Substantially simultaneously, the stored energy and tension effects of the counter-balancing coil spring 101 retainingly secured to the longitudinally extending shoulder stud 107 of the first link 105 at one end and the longitudinally extending shoulder stud 104 of the mounting bracket 102 at an opposite end assist in the over-center movement of the table member 28 and serve to ease such movement. Thereafter, continued movement of table member 28 causes pivot point 111 on the second end of the second link 109 to be driven upwardly for rotating table mounting bracket 103 and table frame 48 about pivot point 108 to the desired horizontal orientation. In this position, pivot point 111 is slightly over-center with respect to second pivot point 108 of the first link 105, such over-center positioning of pivot point 111 allows engagement of the longitudinally-extending limit rod 112 with the first arcuate surface 113 of the first link 105, as assisted by the stored energy of the counter-balancing coil spring 101. Also in this position, the center spacer bar 115 mounted to the first link 105 is also placed in substantially horizontal orientation relative to the table member 28. As further seen in FIG. 11, the upholstered cover 116 retainingly mounted to the table member 28 at one end and retainingly secured to the seat back member 26 at an opposite end by attaching means 117, and is also unfolded following the rotative movement of the table member 28. The upholstered cover 116 provides a cover to conceal the center spacer bar 115 and linkage mechanisms 100 and further serves to interact with the center spacer bar 115 whereby the center spacer bar 115 provides support and rigidity to the upholstered cover 116 when the seat occupant uses the upholstered cover as an armrest.

Turning now to the spring-assisted features of the present invention particularly depicted in FIGS. 12 and 13, it will be appreciated that the tension and stored energy characteristics of the linkage mechanism 100 are associated with the particular angle, configuration, or distance of the longitudinally extending shoulder stud 107 located on the first end 118 of first link relative to pivot point 106. As seen in an intermediate state between the upright closed position and horizontal open position in FIGS. 12 and 13, the coil spring 101 can be extended to a plurality of positions when in the upright closed position depending upon the length or angle associated with the first end 118 of the first link 105 since one end of the coil spring 101 is integrally connected to the longitudinally extending shoulder stud 107 on the first end 118 of the first link 105. Thus, when moving the linkage mechanism 100 to the horizontal open position the first end 118 of the first link 105 pivots about pivot point 106 releasing the stored energy and contracting the coil spring 101 substantially simultaneously to assist in the over-center movement of the table member. Similarly, when moving the linkage mechanism 100 through it latter portions of travel to the horizontal open and to the upright closed positions it will be appreciated that in both situations coil spring 101 is being extended, thus storing energy and cushioning the movement of the sofa table. In this manner a counter-balance force is provided to counter act the gravitational force which otherwise would tend to cause the table member 28 to "fall" into either the open or closed position. The amount of counter-balance force to counter act gravity varies with the weight of the table member (which in turn is affected by the materials used for the table surface), friction of upholstery between adjoining seating units to the detachable sofa back which incorporates the sofa table, and the like. This is shown in FIG. 13 where, upon further movement of the linkage assembly toward the open position, first end 118 of first link 105 begins to extend spring 101 again thereby storing energy which serves to counter-balance the weight of the table member and its tendency to "fall" or bounce into the horizontal open position. It will be appreciated that the present invention contemplates a number of configurations and associated angles of the first end 118 of the first link 105 relative to pivot point 106 which encompass the use of the stored energy characteristics of a coil spring 101, as well as a number of coil springs 101 having different spring constraints, dimension characteristics, and the like.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. In a modular sofa structure including two seat sections and a seat back, a modular bridge section positionable between said sections comprising:

a seat frame;

a seat back assembly having a back member detachably secured to said seat frame and a table member movable between an upright closed position and a horizontal open position, a cushion supported from a front surface of said table member, said cushion adapted to conceal said table member when said table member is in said upright closed position;

linkage means for coupling said table member to said back member for movement between said closed and open positions, said linkage means including a pair of linkage assemblies having first and second links pivotably connected at their opposite ends between said back member and said table member, and stop means associated with each of said second links and engageable with stop tabs formed on one end of each of said first links for positively stopping and supporting said table member in said horizontal open position;

a crossmember fastened to said first links at a location intermediate the opposite ends of said first links, and between said first links, for rigidly securing said linkage means and said table member in a substantially rectangular alignment; and an upholstered cover secured to said seat back assembly above said linkage means at one end and secured to said table member at an opposite end, whereby said upholstered cover conceals said linkage means from view of a seat occupant.

2. The modular sofa structure of claim 1 wherein said stop means are further engageable with opposing stop tabs formed on an opposite end of each of said first links for positively positioning said table member in said upright closed position, said first and second links are constructed and oriented to allow said stop means to interact with said stop tabs to fix said table member in said upright closed position even when said table member does not abut against said back member.

3. The modular sofa structure of claim 1 wherein said crossmember is positioned in an essentially parallel relation to said table member.

4. The modular sofa structure of claim 1 wherein said first and second links include curved outer ends which are joined to said table member from said front surface.

5. The modular sofa structure of claim 1 wherein said linkage means is a four-bar linkage, said stop means including a stop rivet secured to each of said second links and engageable with a first arcuate surface on each of said first links to define a positive stop when said table member is in said horizontal open position.

6. The modular sofa structure of claim 5 wherein each of said stop rivets is also engageable with a second arcuate surface on each of said first links to define a positive stop when said table member is in said upright closed position.

7. An upholstered modular bridge section for use with an article of furniture having at least one adjacent seat section, comprising:

a seat frame;

a seat back assembly having a back member detachably secured to said seat frame and a table member movable between an upright closed position and a horizontal open position;

a pair of linkage assemblies coupling said table member to said back member for movement between said closed and open positions, said linkage assemblies being located on each side of said table member and including first and second links operably connected at their opposite ends between said back member and said table member, said first and second links having curved outer ends pivotably connected to table mounting means for securing said table member, and said first and second links having pivot means for connecting to said back member for enabling said table member to be selectively moved back and forth from said upright closed position to said horizontal open position;

a crossmember fastened to said first links at a location intermediate the opposite ends of said first links, and between said first links, for rigidly securing said linkage mechanism and said table member in a substantially rectangular alignment, said crossmember having a pair of vertically disposed mounting tabs for engaging a vertical surface of said first links; and an upholstered cover secured to said seat back assembly above said linkage means at one end and secured to said table member at an opposite end, whereby said upholstered cover conceals said linkage means from view of a seat occupant.

8. The modular bridge section of claim 7 further comprising spring means for biasing said table member in said open horizontal position, said spring means operably secured to said back member at one end and secured to said first link at an opposite end, whereby said spring means counter-balances said table member in an over-center relationship.

9. The modular bridge section of claim 7 further comprising limit means cooperating with said first and second links for limiting the range of movement of said table member relative to said back member beyond said horizontal open position thereby enhancing rigidity of said table member.

10. The modular bridge section of claim 7 further comprising:

spring means for biasing said table member in said open horizontal position, said spring means operably secured to said back member at one end and secured to said first link at an opposite end, whereby said spring means counter-balances said table member in an over-center relationship; and limit means cooperating with said first and second links for limiting the range of movement of said table member relative to said back member beyond said horizontal open position thereby enhancing rigidity of said table member.

11. The modular bridge section of claim 7 wherein said second link includes a curved outer end pivotably connected to said table mounting means.

12. A linkage mechanism suitable for use with a retractable sofa table comprising:

bracket means for mounting said mechanism to a sofa frame;

a first link pivotably interconnected to said bracket means, said first link having a first stop tab and a second stop tab;

table mounting means pivotable interconnected to said first link and adapted for securement to a table member; and a second link pivotably interconnected between said bracket means and said table mounting means, said second link having stop means secured to an intermediate portion thereof, whereby said first stop tab engages said stop means when said table member is in an upright closed position and said second stop tab engages said stop means when said table member is in a horizontal open position, said first and second stop tabs forming a pair of positive stops; and an upholstered cover secured to said sofa frame above said linkage mechanism at one end and secured to said table member at an opposite end, whereby said upholstered cover conceals said linkage mechanism from view of a seat occupant.

13. The linkage mechanism of claim 12 further comprising means for counter-balancing said table member in an over-center relationship, operably secured to said sofa frame at one end and retainingly secured to said first link at an opposite end.

14. The linkage mechanism of claim 12, further comprising limit means cooperating with said first and second links for limiting the range of movement of said table member relative to said sofa frame beyond a substantially horizontal open position thereby enhancing rigidity of said table member.

15. The linkage mechanism of claim 12 further comprising:

spring means for biasing said table member in a substantially open horizontal open position operably secured to said sofa frame at on end and retainingly secured to said first link at an opposite end whereby said spring means counter-balances said table member in an over-center relationship.

16. The linkage mechanism of claim 12 wherein a center spacer bar is retainingly mounted to said first link, whereby said center spacer bar provides rigidity to said linkage mechanism and said table member.

17. The linkage mechanism of claim 12 wherein a centerboard is retainingly mounted to said first link, whereby said centerboard provides rigidity to said linkage mechanism and said table member.

18. The linkage mechanism of claim 12 having two sets of first and second links, said centerboard mounted on each of said two first links of said two sets of first and second links, whereby said centerboard interconnects said two sets of first and second links in a spaced apart relationship for providing rigidity to said table member.

19. The linkage mechanism of claim 12 wherein each of said first and second links include curved outer ends pivotably interconnected to said table mounting means.

20. An upholstered modular bridge section for use with an article of furniture having at least one adjacent seat section, comprising:

a seat frame;

a seat back assembly having a back member detachably secured to said seat frame and a table member movable between an upright closed position and a horizontal open position;

a pair of mechanisms for moving said table member between said upright closed position and said horizontal open position, each of said mechanisms including:

bracket means adapted for mounting said mechanism to said back member, said bracket means having a first longitudinally extending shoulder stud;

a first link pivotably interconnected to said bracket means spaced apart from said first shoulder stud, said first link having a second longitudinally extending shoulder stud at one end;

table mounting means pivotably interconnected to said first link and adapted for securement to a table member;

a second link pivotably interconnected to said bracket means at one end, and pivotably interconnected with said table mounting means at the opposite end;

spring means for counter-balancing said table member in an over-center relationship retainingly secured to said longitudinally extending shoulder stud of said bracket means at one end and retainingly secured to said longitudinally extending shoulder stud of said first link at an opposite end thereof, whereby said spring means assists a seat occupant in moving said table member between said upright closed position and said horizontal open positions.

21. The modular bridge section of claim 20 further comprising limit means cooperating with said first and second links for limiting the range of movement of said table member relative to said back member beyond said horizontal open position thereby enhancing rigidity of said table member.

22. The modular bridge section of claim 21 wherein said limit means comprise a longitudinally extending limit rod centrally located on said second link which cooperates with an upper arcuate surface located on said first link thereby limiting the forward motion of said table member when in said horizontal open position.

23. The modular bridge section of claim 22 wherein said longitudinally extending limit rod further cooperates with a lower arcuate surface located on said first link thereby limiting the rearward motion of said table member when in said upright closed position.

24. The modular bridge section of claim 20 wherein said first and second links are constructed and oriented to be disposed in a parallel side-by-side relation in abutment with said seat back when said table member is in said upright closed position.

25. The modular bridge section of claim 20 wherein said spring means comprises a coil spring for counter-balancing said table member in an over-center relationship.

26. The modular bridge section of claim 20 wherein a center spacer bar is retainingly mounted to said first link for providing rigidity to said linkage mechanism and said table member.

27. The modular bridge section of claim 20 wherein the end of said first link having said longitudinally extending shoulder stud is angled and spaced apart from the portion of said first link pivotably interconnected to said bracket means.

28. A linkage mechanism suitable for use with a retractable sofa table comprising:

bracket means adapted for mounting said linkage mechanism to a sofa frame, said bracket means having a longitudinally extending shoulder stud;

a first link pivotably interconnected to said bracket means and having a longitudinally extending shoulder stud spaced apart from the interconnection between said first link and said bracket means;

table mounting means pivotably interconnected to said first link and adapted for securement to a table member;

a second link pivotably interconnected to said bracket means at one end, and pivotably interconnected at an opposite end to said table mounting means;

spring means for counter-balancing said table member in an over-center relationship retainingly secured to said longitudinally extending shoulder stud of said bracket means at one end and retainingly secured to said longitudinally extending shoulder stud of said first link at an opposite end thereof for enabling a seat occupant to manipulate said table member from a closed upright position to an open horizontal position.

29. The linkage mechanism of claim 28 further comprising limit means cooperating with said first and second links for limiting the range of movement of said table member relative to said sofa frame beyond said horizontal open position thereby enhancing rigidity of said table member.

30. The linkage mechanism of claim 29 wherein said limit means comprise a longitudinally extending limit rod centrally located on said second link which cooperates with a first arcuate surface located on said first link for limiting the forward motion of said table member when in said horizontal open position.

31. The linkage mechanism of claim 30 wherein said longitudinally extending limit rod further cooperates with a second arcuate surface located on said first link for limiting the rearward motion of said table member when in said upright closed position.

32. The linkage mechanism of claim 28 wherein said spring means comprises a coil spring for counter-balancing said table member in an over-center relationship.

33. The linkage mechanism of claim 28 wherein a center spacer bar is retainingly mounted to said first link for providing rigidity to said linkage mechanism and said table member.

34. The linkage mechanism of claim 28 wherein an upholstered cover is secured to said sofa frame in immediate adjacency above said bracket means at one end, and secured to said table member at an opposite end for concealing said linkage mechanism from view of the seat occupant.

35. The linkage mechanism of claim 28 wherein said end of said first link having said longitudinally extending shoulder stud is angled and spaced apart from the portion of said first link pivotably interconnected to said bracket means.

36. An upholstered modular bridge section for use with an article of furniture having at least one adjacent seat section, comprising:

a seat frame;

a seat back assembly having a back member detachably secured to said seat frame and a table member movable between an upright closed position and a horizontal open position;

a pair of mechanisms for moving said table member between said upright closed position and said horizontal open position, each of said mechanisms comprising:

bracket means for mounting said mechanism to said seat frame, said bracket means having a first attachment point;

a first link pivotably secured at an intermediate portion thereof to said bracket means at an upper bracket pivot, said first link having a second attachment point at an inboard end, said first link further including a first stop tab and a second stop tab;

table mounting means pivotably interconnected to said first link and adapted for securement to said table member;

a second link pivotably secured to said bracket means at one end, and pivotably secured to said table mounting means at the opposite end, said second link having stop means secured to an intermediate portion thereof, whereby said first stop tab engages said stop means when said table member is in said upright closed position and said second stop tab engages said stop means when said table member is in said horizontal open position, said first and second stop tabs forming a pair of positive stops; and spring means retainingly secured between said first attachment point of the bracket means and said second attachment point of said first link for counter-balancing said table member in an over-center relationship;

an upholstered cover secured to said seat back assembly above said pair of mechanisms at one end and secured to said table member at an opposite end, whereby said upholstered cover conceals said linkage means from view of a seat occupant; and whereby said spring means assists in moving said table member between said upright closed position and said horizontal open position.

37. The modular bridge section of claim 36 wherein said spring means comprises a coil spring.

* * * * *